US006082436A

United States Patent [19]

Divecha et al.

[11] Patent Number: 6,082,436

[45] Date of Patent: Jul. 4, 2000

[54] METHOD OF CENTRIFUGALLY CASTING REINFORCED COMPOSITE ARTICLES

[75] Inventors: Amarnath P. Divecha, Falls Church; Subhash D. Karmarkar, Great Falls, both of Va.; Philip Hesse, Ellicott City; William J. Bruchey, Port Deposit, both of Md.

[73] Assignee: The United States of America as represented by the Secretary of the Navy, Washington, D.C.

[21] Appl. No.: 09/238,891

[22] Filed: Jan. 28, 1999

Related U.S. Application Data

[60] Continuation of application No. 08/070,609, Jun. 2, 1993, abandoned, which is a division of application No. 08/067,505, May 25, 1993, Pat. No. 5,337,803, which is a continuation-in-part of application No. 07/704,563, May 17, 1991, Pat. No. 5,295,528.

[51] Int. Cl.[7] ..... B22D 13/02; B22D 19/02

[52] U.S. Cl. ..... 164/72; 164/75; 164/98; 164/100; 164/112; 164/114

[58] Field of Search ..... 164/98, 75, 97, 164/100, 112, 114, 72

[56] References Cited

U.S. PATENT DOCUMENTS

| | | | |
|---|---|---|---|
| 1,982,762 | 12/1934 | Russell et al. | 164/72 X |
| 2,246,063 | 6/1941 | Projahn | 164/72 X |
| 3,264,697 | 8/1966 | Price et al. | 164/75 X |
| 4,279,289 | 7/1981 | Ban et al. | 164/97 |
| 4,631,793 | 12/1986 | Shintaku et al. | 164/97 X |
| 4,899,800 | 2/1990 | Gallerneault et al. | 164/100 X |
| 4,958,763 | 9/1990 | Divecha et al. | 228/193 |
| 4,980,123 | 12/1990 | Gedeon et al. | 164/75 X |
| 5,295,528 | 3/1994 | Divecha et al. | 164/75 |
| 5,337,803 | 8/1994 | Divecha et al. | 164/98 |

FOREIGN PATENT DOCUMENTS

| | | | |
|---|---|---|---|
| 59-16662 | 1/1984 | Japan | 164/97 |
| 1-254365 | 10/1989 | Japan | 164/97 |

*Primary Examiner*—J. Reed Batten, Jr.

*Attorney, Agent, or Firm*—John Forrest; Jacob Shuster

[57] ABSTRACT

The article is produced by prepositioning nonwoven reinforcement, coated with a bond enhancing compound inside of a centrifugal casting mold that is surface coated for protective shielding of the reinforcement. Molten matrix metal is then introduced into the mold while being rotated about its longitudinal axis until the molten metal completely encapsulates the reinforcement.

4 Claims, 7 Drawing Sheets

METHOD OF CENTRIFUGALLY CASTING REINFORCED COMPOSITE ARTICLES

This application is a continuation of application Ser. No. 08/070,609 filed Jun. 2, 1993, now abandoned, which is a division of application Ser. No. 08/067,505 filed May 25, 1993, now U.S. Pat. No. 5,337,803, which is a continuation-in-part of application Ser. No. 07/704,563 filed May 17, 1991, now U.S. Pat. No. 5,295,528.

BACKGROUND OF THE INVENTION

This application is a continuation of Ser. No. 08/070,609 filed Jun. 2, 1993, which in general relates to articles reinforced with discontinuous composites and the like, and a process of makong the same. In particular, the invention relates to the use of reinforcement preforms in microstructurally toughened articles formed by casting.

PRIOR ART

Discontinuous metal matrix composites (MMC) have relatively recently been used industrially. The most widely used discontinuous composites are silicon carbide whiskers (SiC) and silicon carbide particles (SiCp) or (SiCw).

Discontinuously reinforced aluminum is commonly designated as SiC/Al and $SiC_p$/Al, respectively. These composites are manufactured by either powder metallurgy (PM) or ingot metallurgy (IM). The PM composites are considerably more expensive than the IM composites, but the PM composites are preferred in certain applications because of their higher strength.

At present time IM composites are limited to about twenty volume percent SiCp in one matrix; namely, A 356 aluminum alloy. A deterrent to their application and widespread use is their brittleness or lack of ductility. For example, in structural applications, designers demand fatigue resistance and fracture toughness at least equal to or greater than the contemporary material it is replacing. In most cases, metal matrix composites, including SiCp/Al, are brittle in the classical sense. Monolithic aluminum is tough material but SiC/Al is very brittle. An increase in strength and modulus (as achieved by incorporating SiC in Al) accompanied by a decrease in density, is not sufficient unless accompanied by good fracture toughness.

In one attempt to improve the toughness of discontinuous metal matrix composites, extruded rods of PM SiCp/Al composites were inserted in a soft aluminum tube. These were than assembled and hot isostatically compacted in a can to form a billet. This billet was then extruded at elevated temperatures using a moderate extrusion ratio. The resulting composite portion of the extruded billet contained a much smaller volume of SiC because of dilution of the matrix by the monolithic aluminum tubes. As expected, the composite strength and modulus were reduced proportionately by an amount which can be calculated by the law of mixtures.

However, in the above example, composite fracture toughness increases by an order of magnitude over that of the reinforced matrix, specifically the impact strength which is a good test for measuring the toughness of a material. The microstructurally toughened composite impact strength is found to be nineteen ft. lbs. as compared to a monolithic unreinforced aluminum matrix having a toughness of 3–4 ft. lb. The PM rods of $SiC/_{Al}$ by themselves also exhibit low impact strength ranging from 0.6 to 1.0 ft. lb.

It is also known to produce rods of graphite fiber reinforced glass matrix, known as Gr/glass which has very high strength, low density and high modulus. This process toughens glass; consequently, the Gr/glass will not shatter like monolithic glass even under repeated blows.

It is desirable to have an economical process for producing microstructurally toughened, discontinuously reinforced tubes and other articles, in which non-woven or rod-like reinforcing material can be distributed at desired locations within the wall of the article. It is also desirable to have a process for producing microstructurally toughened discontinuous articles in which hybrid composite combinations of materials forming the non-woven type of reinforcement can be located at critical locations within the article wall.

SUMMARY OF THE INVENTION

In accordance with the present invention, a process is provided for forming a microstructurally toughened discontinuous composite article, having a non-woven reinforcement therein, by casting in a hollow mold. The process includes the steps of (a) coating the reinforcing members, (b) prepositioning the coated reinforcing members inside the mold at pre-selected locations and, (c) introducing molten matrix metal into mold to form an annular shape incorporating the precast reinforcing members to microstructurally toughen the article. In this way, tubes or other shapes can be produced with differing amounts of reinforcements in any desired position in the product wall. Such reinforcements can be formed of composite materials which differ from the matrix metal being cast.

BRIEF DESCRIPTION OF THE DRAWING FIGURES

Other objects, advantages and novel features of the invention will become apparent form the following detailed description of the invention when considered in conjunction with the accompanying drawing wherein.

Figure 3:
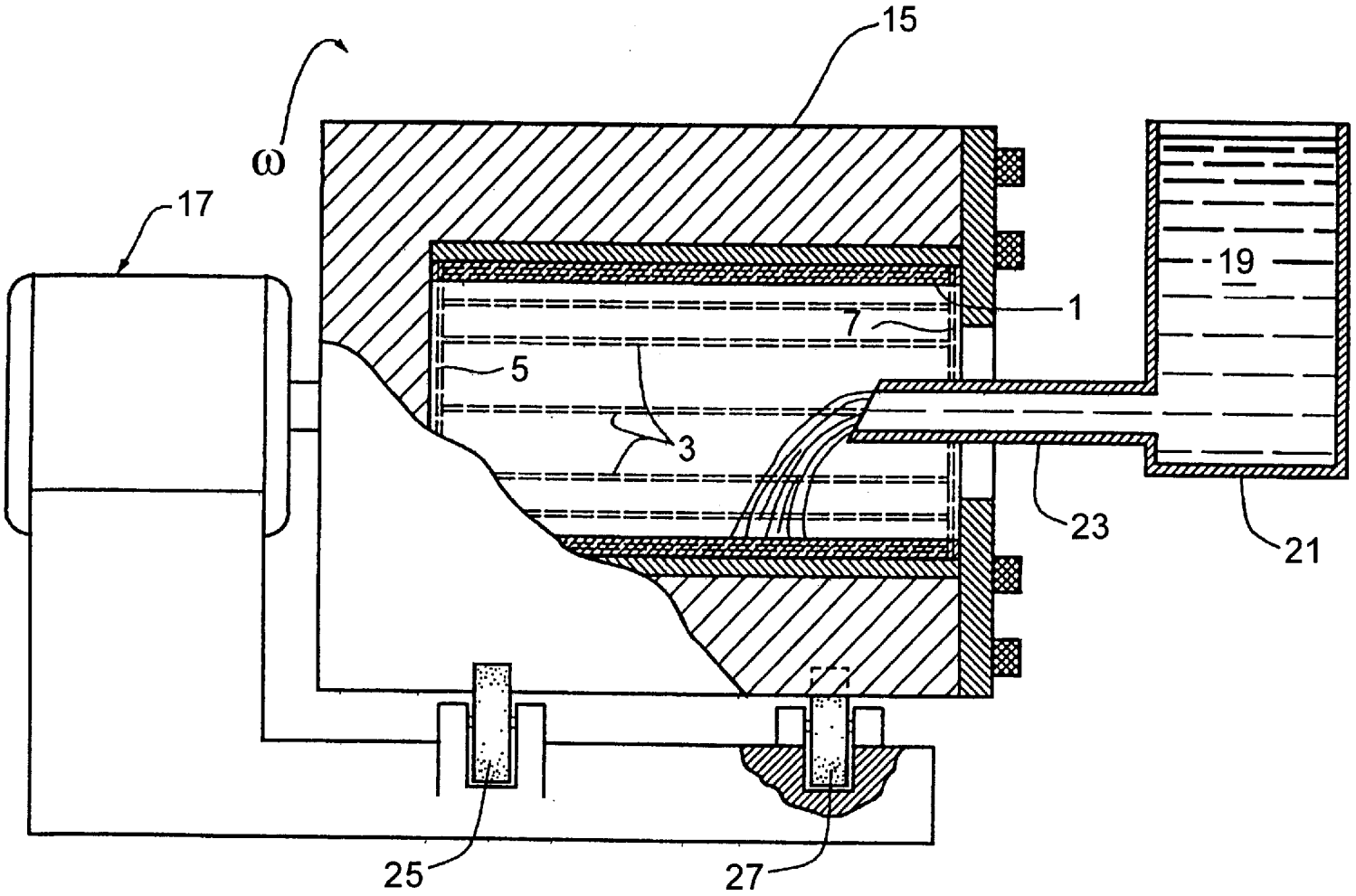
Figure 4:
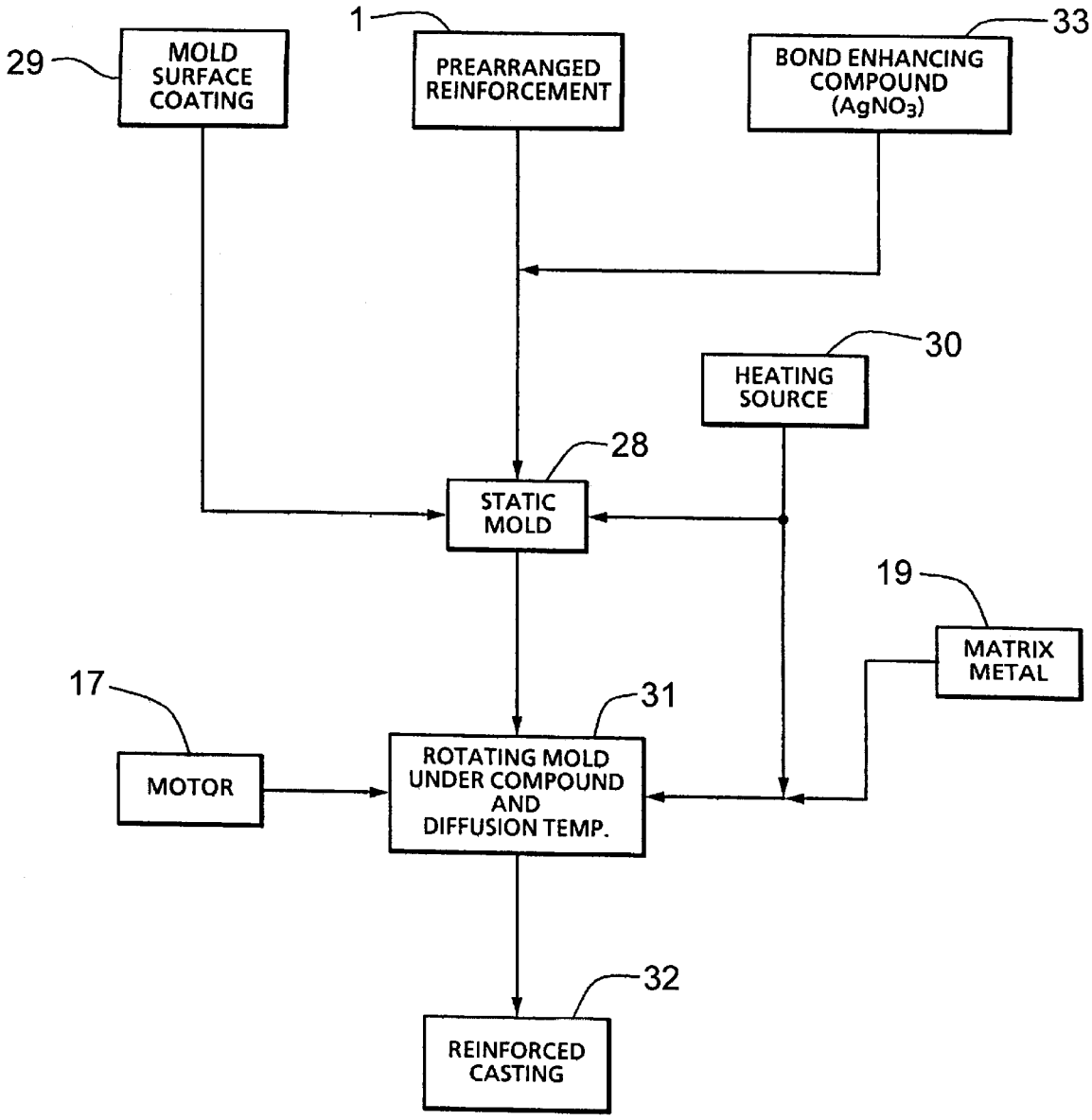
Figure 5:
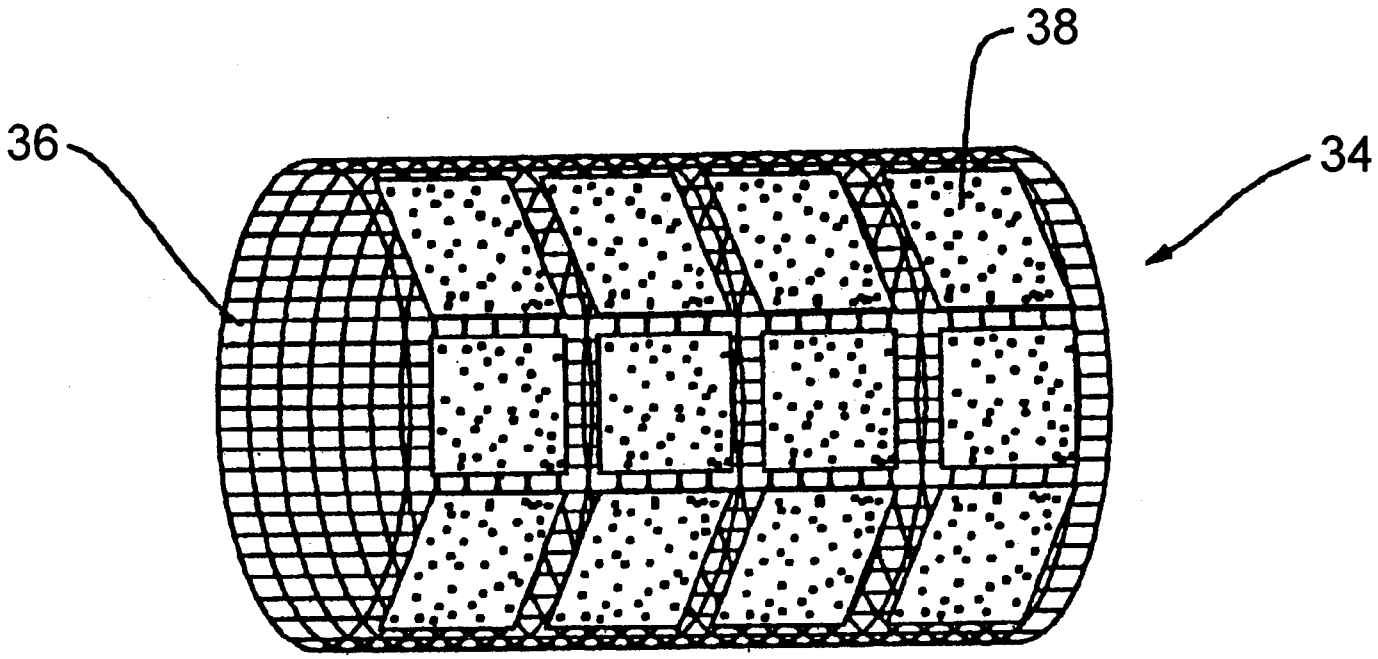

FIG. 3 is a cross-sectional view of a centrifugal casting device illustrating the positioning of the reinforcement in the hollow mold when molten metal is introduced while carrying out centrifugal casting operation in the mold, FIG. 4 is a diagram outlining the process of the present invention, FIG. 5 is a perspective view of a reinforcement preform having ceramic tiles, according to another embodiment.

Figure 6:
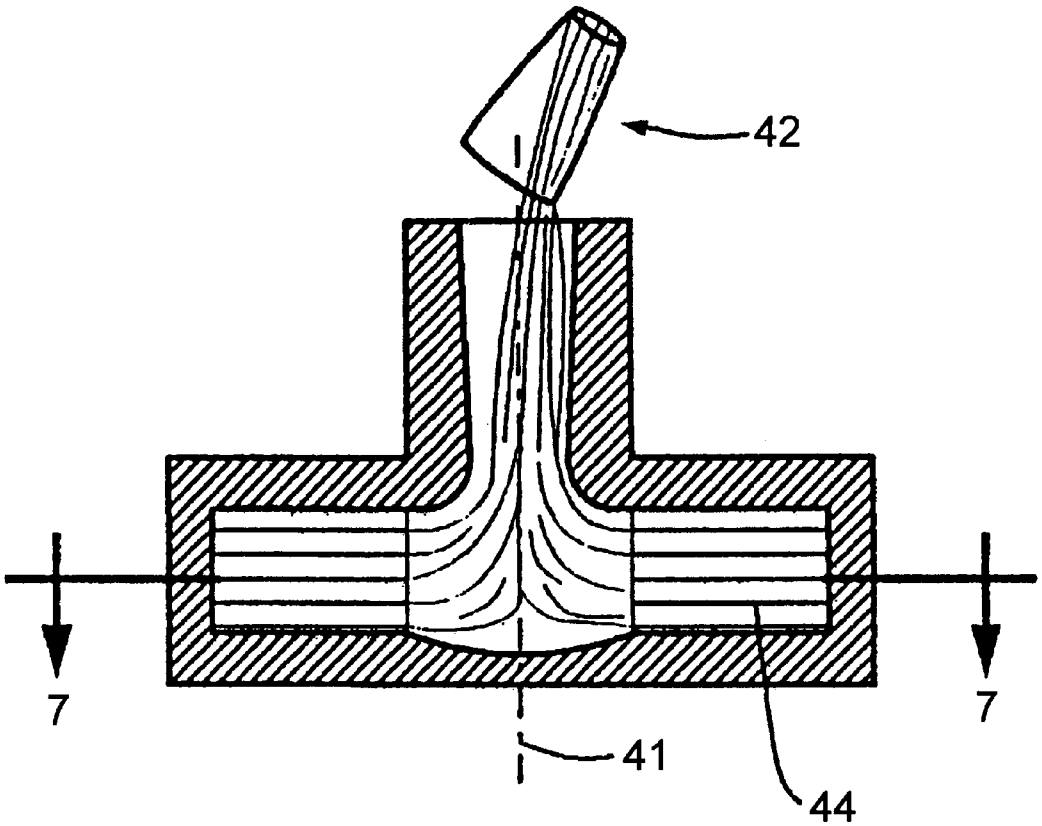
Figure 7:
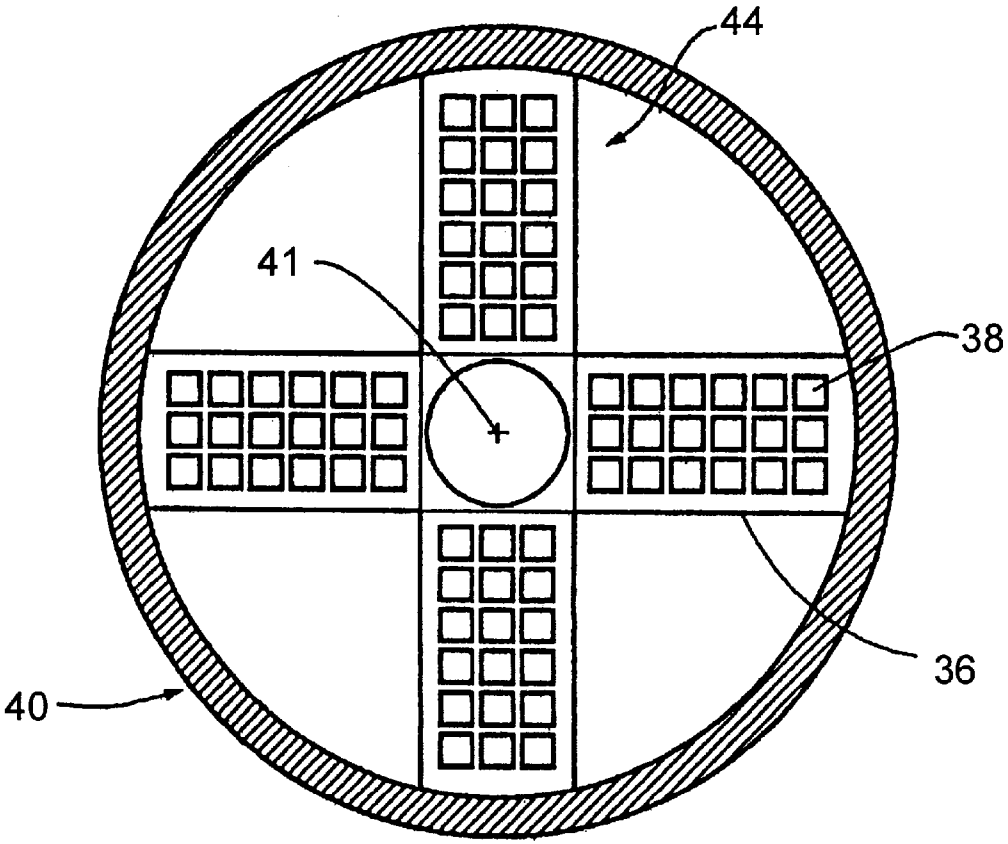

FIG. 6 is a cross-sectional view of a centrifugal casting device according to another embodiment wherein molten metal is vertically introduced into an annular mold within which a reinforcement preform is positioned, and FIG. 7 is a section view taken substantially through a plane indicated by section line 7—7 in FIG. 6.

DETAILED DESCRIPTION OF THE PREFERRED EMBODIMENT

Figure 1:
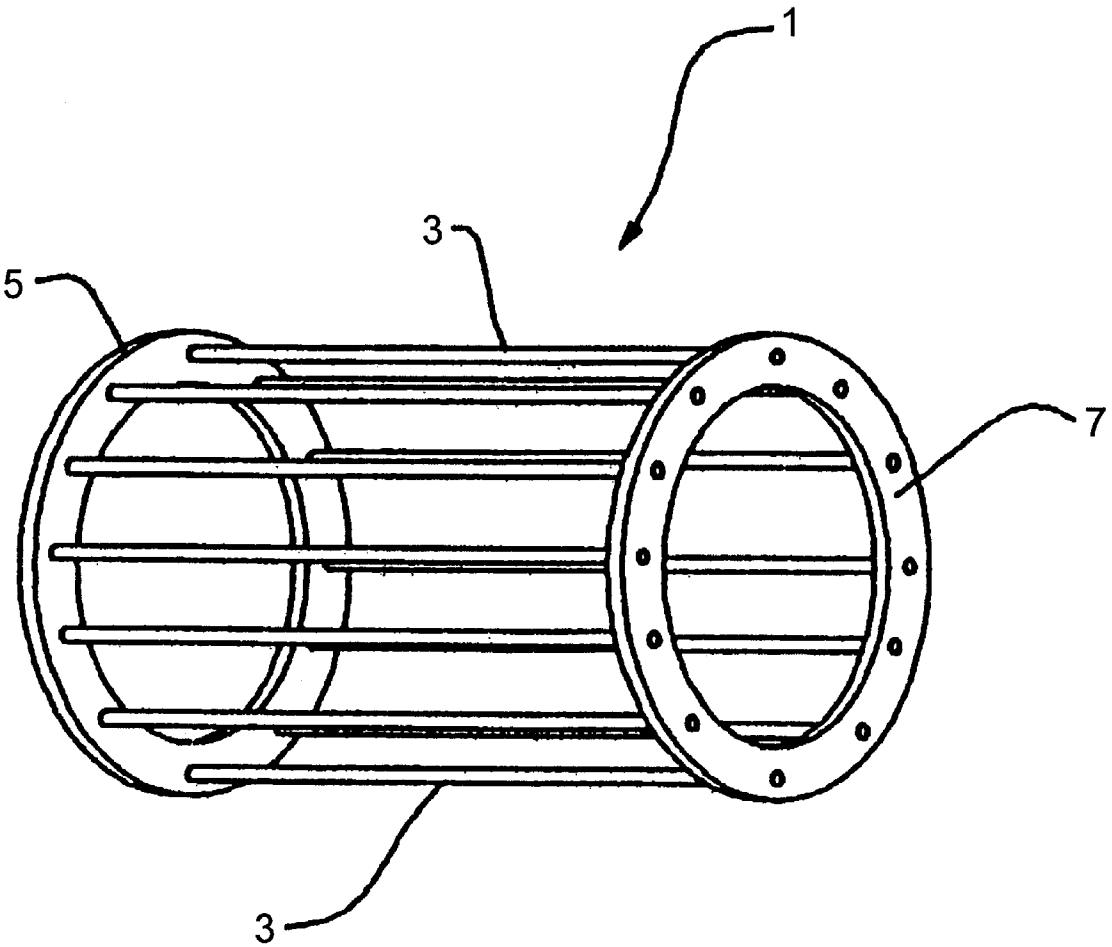
FIG. 1 is a perspective view of reinforcement preform according to one embodiment including a plurality of reinforcing ($SiC_p$Almmc) rods held in pre-selected positions in circular frames.

According to one embodiment of the present invention, a non-woven reinforcement preform, generally referred to as 1 in FIG. 1, comprises a plurality of parallel rods 3 longitudinally extending between circular frames 5 and 7. Such reinforcement preform is to be incorporated into a hollow mold generally referred to by reference numeral 15 as shown in FIG. 3. The reinforcement preform is positioned within mold 15 while it is stationary so that the rods 3 are held in the desired positions during a subsequent casting operation by the circular holding frames 5 and 7 to which they are connected as shown in FIG. 1. A motor 17 as shown in FIG. 3, causes the mold 15 to rotate while molten metal 19 is discharged from a storage crucible 21 through spout 23 directly into the rotating mold 15 during the casting operation. Rollers 25 and 27 contact the mold 15 for support thereof while it is being rotated as shown in FIG. 3.

Figure 2:
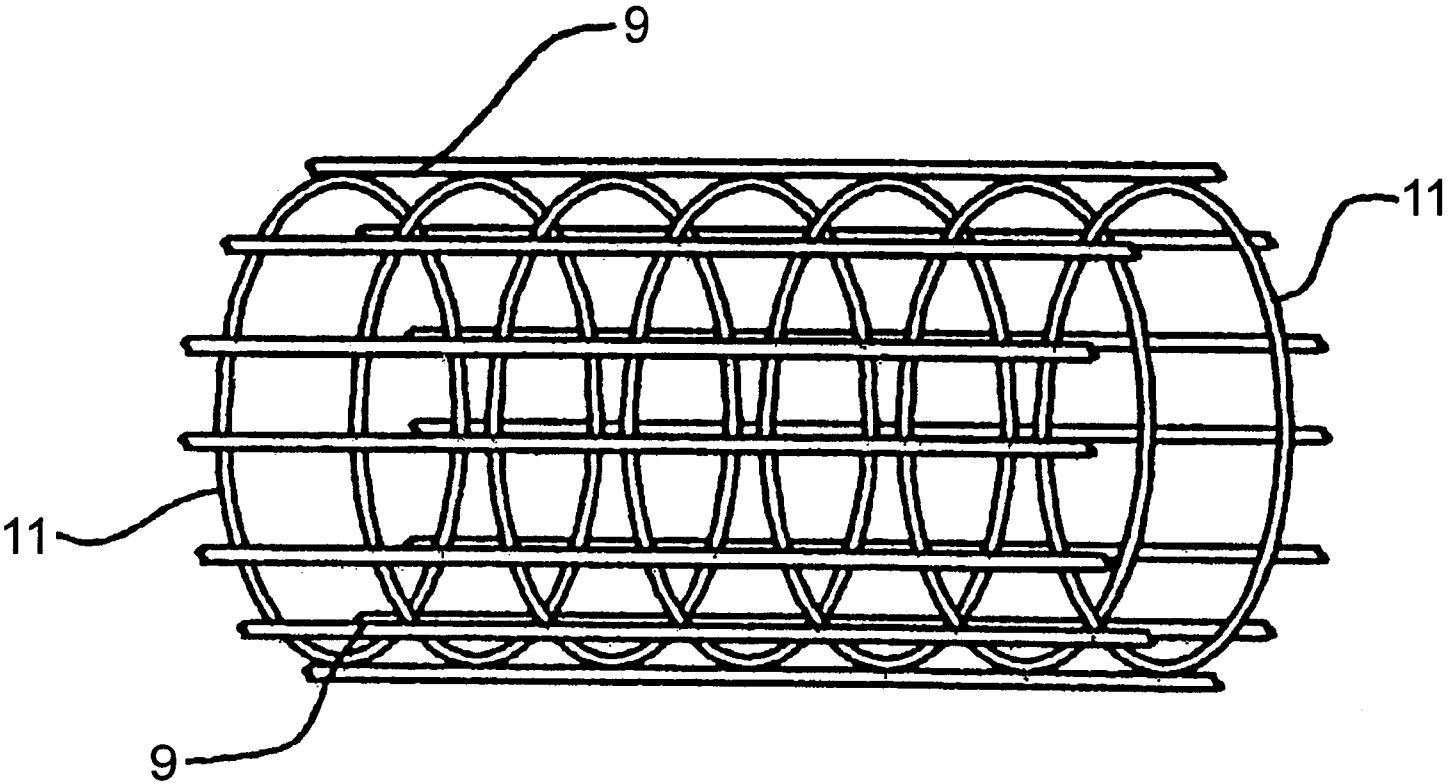
FIG. 2 is a perspective view of a reinforcement preform in the form of a plurality of hoop-shaped reinforcing rods held in pre-selected positions with longitudinally extending reinforcing rods.

According to the embodiment shown in FIG. 2, an alternative reinforcement preform comprises a plurality of hoop-shaped elements 9 made of composite materials Gr.Al, B/Al, Gr/glass, $B_4C$.metal, $Ni_3Al/Cu$, $SiC_p/Al$. The hoops 9 are interconnected in axially spaced relation to each other by longitudinally extending parallel rods 11 which are secured thereto. The reinforcement assembly shown in FIG. 2 can be inserted into the cavity of a mold to provide reinforcing support for the tube walls of a casting in much the same manner as the reinforcement preform 1 shown in FIG. 3.

The reinforcement preform 1 is utilized pursuant to the present invention in a typical casting operation as diagrammed in FIG. 4, which also involves rotation of mold 15 by motor 17. As also diagrammed in FIG. 4, the mold surface while in a static condition 28 of the mold is coated with release compounds 29 such as alumina, graphite, clay and combinations of these materials. The mold is preferably heated to a temperature of 300° C. of superheat by a suitable heating source 30 prior to the introduction of the molten metal 19 into the mold 15 in its rotating condition 31. Preferably, the matrix metal which is held in the crucible 21 at a superheat of approximately 700° C., is introduced through nozzle 23, also preheated to about 250° C. The matrix metal 19 is introduced into the mold 15 during its rotation at a high angular velocity. During such process, the matrix metal encapsulates the reinforcement preform before cooling and solidification to form the reinforced casting 32 as diagrammed in FIG. 4. The parameters established for centrifugal casting of SiC/Al as the matrix metal can be used with only minor changes in casting tubes having the reinforcing members according to the present invention.

A critical element of successful casting with the reinforcing rods is the coating step involving the formation of a silver coating layer from a compound 33 as diagrammed in FIG. 4 to provide a strong bond by shielding SiC/Al as the reinforcement material from oxidation and from direct reaction with the heated metal matrix 19 during the casting operation. The layer or interface of coating 29 also provides good wetting to the matrix aluminum such that subsequent thermal treatment can be employed to produce diffusion of silver into both reinforcement and matrix, further enhancing the bond strength.

The silver coating process involved herein utilizes the physical properties unique to the bond enhancing compound 33 in the form of silver nitrate ($AgNO_3$). Such a coating process is disclosed in U.S. Pat. No. 4,988,673 and is also disclosed more particularly with respect to the coating of aluminum in U.S. Pat. No. 4,958,763. There are several advantages to this relatively low temperature, simply applied method of silver coating. The most important, in the case of aluminum (and its alloys), is its apparent ability to displace the thin oxide layer which is always present to a sufficient extent on an aluminum surface necessary to allow diffusion of the silver into the aluminum surface producing the strong bond.

The $AgNO_3$ coating is applicable to a wide spectrum of reinforcement materials and matrix alloys. For example, titanium or steel reinforcement could be used as well as Al—Mg or Al—Li alloys. The Ag coating thickness, which typically has been found to be about 10 microns, can be reduced by diluting the $AgNO_3$ prior to application or increased by repeating the coating steps.

According to one preferred embodiment, the reinforcing rods are formed of a composite material which is similar to the matrix being centrifugally cast as the main component of the tubular shape. For example, where an aluminum or aluminum alloy tube is desired, the reinforcing rods are preferably made of a composite material such as SiC/Al and Al, Gr/Al, B/Al, or $B_4C$/Al.

One or more layers of the reinforcing rods may be incorporated into the tube to be cast. According to the present invention, various hybrid composite combinations can be used such as SIC/Mg cast with aluminum or its alloys to provide improved corrosion resistance. Also, other compatible combinations of materials and composites may be used, including intermetalic matrix composites, high temperature combinations such as $Al_20_3$/INCO 718, $B_4C$/Cu, $Ni_3Al$ matrix reinforced with continuous SiC filaments ($Ni_3Al/SiC_F$) and $Ti_3Al/SiC_F$ to respectively produce microstructurally toughened tubes and articles by centrifugal casting. Thus, nickel or its alloy may be cast around $Al_20_3$/INC0718 to obtain a reinforced and toughened tube analogous to $SiC_p/Al$ in an aluminum alloy. If needed, copper or its alloy can be reinforced and toughened with $A1_20_3$/INCO 718 rods.

According to the present invention, the use of the composite reinforcing members will result in an improvement in the fracture toughness without sacrificing stiffness and strength to a significant extent. The degree of improvement will depend upon the volume fraction of the monolithic component of the composite and its inherent toughness. The choice of being able to select the monolithic component makes it possible to tailor the properties of the tube. For example, a monolithic component of the reinforcing materials such as Al or its alloys can be used with $SiC_p/Al$ reinforcing rods to produce an article having toughness 3 to 4 times that of the components themselves.

In a preferred embodiment, Gr/glass rods can be advantageously used with an aluminum matrix metal. The advantage of the Gr/glass over SiC/Al in this specific case is the oxidation resistance of the Gr/glass. While the silicon carbide/aluminum (SiC/Al) will oxidize during preheating of the mold, the Gr/glass will not. As a result, silver coating needed for protection and bonding of SiC/Al is unnecessary. In addition, glass matrix is easily wetted by molten aluminum or the alloys thereof. Therefore, the adhesion at the interface between the matrix and the rods (of Gr/glass) is virtually instantaneous. In a preferred embodiment, a tube of titanium or its alloys can be used to toughen the composite to a very high degree by inserting a rod of SiC/Al into a titanium or titanium alloy tube which is preferably first silverized with $AgNO_3$. In this procedure, the rod is inserted into the titanium or titanium alloy tube and mildly swagged to create an intimate contact between the two mating surfaces. If necessary, the reinforcement preform may be diffusion treated to create a bond at the interface between the silicon carbide/aluminum rod or the titanium or the titanium alloy tube. The rods prepared in this manner can then be placed in the mold in preselected positions and the centrifugal casting operation carried out in the manner hereinbefore described. The advantage of this embodiment over the other composites described hereinbefore is that the titanium or titanium alloy is much stronger and tougher than aluminum and its alloys. Titanium and its alloys are also stiffer than aluminum with a modulus of 14 Msi. Also, the titanium and titanium alloys is denser than both aluminum and SiC/Al and therefore the resultant composite tube will be heavier than one without the titanium or the titanium alloy. This particular embodiment is suitable where toughness is the most important criteria. In another preferred embodiment, the titanium or titanium alloy tube can be used with a rod swagged therein of $B_4$ $C_p$/Cu or $A1_20_3$/$Ni_3$/Al.

According to still other embodiments of the invention, the reinforcement preforms formed exclusively from rods 3 as shown in FIG. 1 or from rods 9 and 11 as shown in FIG. 2, may be replaced by a reinforcement preform generally referred to by reference numeral 34 in FIG. 5. The preform 34 consists of stainless steel rods forming a cylindrically-shaped mesh 36 to which ¼ inch thick, square ceramic tiles 38 are wired, as shown. The tiles are made of aluminum oxide ($Al_20_3$) and are typically 1"×1"×¼" in dimension.

The reinforcement preform 34 is positioned within a mold while it is stationary as hereinbefore described with respect to FIG. 3, before the centrifugal casting operation is performed by introducing the molten metal matrix into the rotating mold to produce a cylindrical reinforced composite product. The metal matrix according to one embodiment utilizing reinforcement preform 34 is aluminum.

The present invention also contemplates formation of composite products by centrifugal casting of the molten metal by vertically introducing the same into a mold 40 rotating about a vertical axis 41 from a heated funnel 42 as shown in FIG. 6. Flat panel reinforcement preforms 44, as more clearly seen in FIG. 7, are positioned perpendicular to axis 41 within mold 40 while stationary. The preforms 44, made of stainless steel mesh, also include ceramic tiles 38 wired thereto on radial spoke portions 46. The molten casting metal engulfs the preforms 44, including the tiles 38.

The ceramic tiles 38 being made of alumina in the embodiments illustrated in FIGS. 5, 6 and 7, have a higher melting point than the stainless steel mesh 36 of their reinforcement preforms and may therefore be of value in the formation of composite armor type products.

Obviously, numerous other modifications and variations of the present invention are possible in light of the foregoing teachings. It is therefore to be understood that within the scope of the appended claims the invention may be practiced otherwise than as specifically described.

What is claimed is:

1. In a process of forming an article which embodies a metallic preform having an axis, including the steps of: coating the preform to enhance bonding thereof; positioning the coated preform within a mold of a centrifugal casting device; protectively shielding the coated preform within the mold in a static condition; and introducing a metal in a molten state into the mold during rotation thereof to encapsulate the coated preform within the mold after said protective shielding is performed in the static condition of the mold.

2. The process as defined in claim 1 wherein said preform is of tubular shape and said rotation of the mold is effected about said axis of the preform positioned therein.

3. In a process of forming an article which embodies a metallic preform, including the steps of: coating the preform to enhance bonding thereof; positioning the coated preform within a mold of a centrifugal casting device; applying a surface layer of a release compound to the mold in a static condition prior to said positioning therein of the coated preform for subsequent protective shielding of the coated preform within the mold; and introducing a metal in a molten state into the mold during rotation thereof to encapsulate the coated preform while under said protective shielding within the mold.

4. The process as defined in claim 3, wherein said coating of the prepared preform comprises covering thereof with a layer of a bond enhancing compound.

* * * * *